US008024181B2

(12) United States Patent
Ehara et al.

(10) Patent No.: US 8,024,181 B2
(45) Date of Patent: Sep. 20, 2011

(54) SCALABLE ENCODING DEVICE AND SCALABLE ENCODING METHOD

(75) Inventors: Hiroyuki Ehara, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1100 days.

(21) Appl. No.: 11/573,761

(22) PCT Filed: Sep. 2, 2005

(86) PCT No.: PCT/JP2005/016099

§ 371 (c)(1),
(2), (4) Date: Feb. 15, 2007

(87) PCT Pub. No.: WO2006/028010

PCT Pub. Date: Mar. 16, 2006

(65) Prior Publication Data

US 2007/0271092 A1 Nov. 22, 2007

(30) Foreign Application Priority Data

Sep. 6, 2004 (JP) ..... 2004-258924

(51) Int. Cl.
*G10L 19/02* (2006.01)

(52) U.S. Cl. ..... 704/217; 704/222

(58) Field of Classification Search ..... 704/200, 704/201, 205, 216–223, 500
See application file for complete search history.

(56) References Cited

U.S. PATENT DOCUMENTS 5,710,863 A * 1/1998 Chen ..... 704/200.1
5,819,212 A * 10/1998 Matsumoto et al. ..... 704/219
6,078,879 A * 6/2000 Taori et al. ..... 704/207
6,208,957 B1 3/2001 Nomura
6,539,355 B1 * 3/2003 Omori et al. ..... 704/268
6,675,144 B1 * 1/2004 Tucker et al. ..... 704/264

(Continued)

FOREIGN PATENT DOCUMENTS

JP 8-123495 5/1996

(Continued)

OTHER PUBLICATIONS

Lo, K.C et al.; Computing circular auto-correlation of randomly sampled sequences; IEEE International Symposium on Circuits and System, Jun. 9-12, 1997, Hong Kong, pp. 2657-2660.*

(Continued)

*Primary Examiner* — Abul K Azad
(74) *Attorney, Agent, or Firm* — Greenblum & Bernstein, P.L.C.

(57) ABSTRACT

There is provided a scalable encoding device capable of realizing a bandwidth scalable LSP encoding with high performance by improving the conversion performance from narrow band LSPs to wide band LSPs. The device includes: an autocorrelation coefficient conversion unit (301) for converting the narrow band LSPs of Mn order to an autocorrelation coefficients of Mn order; an inverse lag window unit (302) for applying a window which has an inverse characteristic of a lag window supposed to be applied to the autocorrelation coefficients; an extrapolation unit (303) for extending the order of the autocorrelation coefficients to (Mn+Mi) order by extrapolating the inverse lag windowed autocorrelation coefficients; an up-sample unit (304) for performing an up-sample process in the autocorrelation domain which is equivalent to an up-sample process in a time domain for the autocorrelation coefficients of the (Mn+Mi) order so as to obtain autocorrelation coefficients of Mw order; a lag window unit (305) for applying a lag window to the autocorrelation coefficients of Mw order; and an LSP conversion unit (306) for converting the lag windowed autocorrelation coefficients into LSPs.

14 Claims, 9 Drawing Sheets

U.S. PATENT DOCUMENTS

| | | | | |
|---|---|---|---|---|
| 6,732,070 | B1 * | 5/2004 | Rotola-Pukkila et al. | 704/219 |
| 6,795,805 | B1 | 9/2004 | Bessette et al. | |
| 6,807,524 | B1 | 10/2004 | Bessette et al. | |
| 7,013,269 | B1 * | 3/2006 | Bhaskar et al. | 704/219 |
| 7,343,282 | B2 * | 3/2008 | Kirla et al. | 704/212 |
| 7,392,195 | B2 * | 6/2008 | Fejzo | 704/500 |
| 2001/0027390 | A1 * | 10/2001 | Rotola-Pukkila et al. | 704/219 |
| 2003/0093279 | A1 | 5/2003 | Malah et al. | |
| 2005/0108005 | A1 | 5/2005 | Bessette et al. | |
| 2005/0108007 | A1 | 5/2005 | Bessette et al. | |
| 2005/0256709 | A1 | 11/2005 | Ozawa | |
| 2007/0223577 | A1 * | 9/2007 | Ehara et al. | 375/240.03 |
| 2008/0249766 | A1 * | 10/2008 | Ehara | 704/203 |

FOREIGN PATENT DOCUMENTS

| | | |
|---|---|---|
| JP | 9-101798 | 4/1997 |
| JP | 9-127985 | 5/1997 |
| JP | 2000-122679 | 4/2000 |
| JP | 3134817 | 12/2000 |
| JP | 2002-528777 | 9/2002 |
| JP | 2003-241799 | 8/2003 |
| JP | 2004-151423 | 5/2004 |

OTHER PUBLICATIONS

Ehara et al., "Predictive VQ for Bandwidth Scalable LSP Quantization", Acoustics, Speech, and; and Signal Processing, 2005. Proceedings. (ICASSP '05). IEEE International Conference on Philadelphia, Pennsylvania, USA Mar. 18-23, 2005, Piscataway, NJ, USA, IEEE, Mar. 18, 2005, pp. 137-140. XP010791993.

Nomura et al., "A bitrate and bandwidth scalable CELP coder", Acoustics, Speech and Signal Processing, 1998. Proceedings of the 1998 IEEE International Conference on Seattle, WA, USA May 12-15, 1998, New York, NY, USA, IEEE, US, vol. 1, May 12, 1998, pp. 341-344, XP010279059.

English Language Abstract of JP 2000-122679.

English Language Abstract of JP 8-123495.

English Language Abstract of JP 2004-151423.

English Language Abstract of JP 2002-528777.

English Language Abstract of JP 9-127985.

English Language Abstract of JP 9-101798.

English Language Abstract of JP 2003-241799.

English Language Abstract of JP 11-030997.

Koishida et al. "Enhancing MPEG-4 CELP by Jointly Optimized Inter/Intra-Frame LSP Predictors", IEEE Speech Coding Workshop 2000, Proceeding , pp. 90-92, Sep. 20, 2000.

Saito et al, "Foundations of Speech Information Processing", Ohmsha, Nov. 30, 1981, p. 91, together with a partial English language translation of the same, Nov. 30, 1981.

H. Ehara et al., "Kyotaiiki-Kotaiiki Yosoku Model ni Motozuku Taiiki Scalable LSP-Ryoshika (scalable LSP quantization based on a narrowband-wideband prediction model)", FIT2004 (Forum on Information Technology 2004), Information Technology Letters, vol. 3, Aug. 20, 2004, pp. 139-141.

Partial English language translation of Document 1 of this paper, Document 1 being dated Aug. 20, 2004.

Japanese Office Action in JP 2006-535719, dated May 24, 2011.

* cited by examiner

SCALABLE ENCODING DEVICE AND SCALABLE ENCODING METHOD

TECHNICAL FIELD

The present invention relates to a scalable encoding apparatus and scalable encoding method that are used to perform speech communication in a mobile communication system or a packet communication system using Internet Protocol.

BACKGROUND ART

There is a need for an encoding scheme that is robust against frame loss in encoding of speech data in speech communication using packets, such as VoIP (Voice over IP). This is because packets on a transmission path are sometimes lost due to congestion or the like in packet communication typified by Internet communication.

As a method for increasing robustness against frame loss, there is an approach of minimizing the influence of the frame loss by, even when one portion of transmission information is lost, carrying out decoding processing from another portion of the transmission information (see Patent Document 1, for example). Patent Document 1 discloses a method of packing encoding information of a core layer and encoding information of enhancement layers into separate packets using scalable encoding and transmitting the packets. As application of packet communication, there is multicast communication (one-to-many communication) using a network in which thick lines (broadband lines) and thin lines (lines having a low transmission rate) are mixed. Scalable encoding is also effective when communication between multiple points is performed on such a non-uniform network, because there is no need to transmit various encoding information for each network when the encoding information has a layer structure corresponding to each network.

For example, as a bandwidth-scalable encoding technique which is based on a CELP scheme that enables high-efficient encoding of speech signals and has scalability in the signal bandwidth (in the frequency axis direction), there is a technique disclosed in Patent Document 2. Patent Document 2 describes an example of the CELP scheme for expressing spectral envelope information of speech signals using an LSP (Line Spectrum Pair) parameter. Here, a quantized LSP parameter (narrowband-encoded LSP) obtained by an encoding section (in a core layer) for narrowband speech is converted into an LSP parameter for wideband speech encoding using the equation (1) below, and the converted LSP parameter is used at an encoding section (in an enhancement layer) for wideband speech, and thereby a band-scalable LSP encoding method is realized.

$$fw(i)=0.5\times fn(i)\ [\text{wherein; } i=0,\ldots,P_n-1]$$

$$=0.0\ [\text{wherein; } i=P_n,\ldots,P_w-1] \quad (1)$$

In the equation, fw(i) is the LSP parameter of ith order in the wideband signal, fn(i) is the LSP parameter of ith order in the narrowband signal, $P_n$ is the LSP analysis order of the narrowband signal, and $P_w$ is the LSP analysis order of the wideband signal.

In Patent Document 2, a case is described as an example where the sampling frequency of the narrowband signal is 8 kHz, the sampling frequency of the wideband signal is 16 kHz, and the wideband LSP analysis order is twice the narrowband LSP analysis order. The conversion from a narrowband LSP to a wideband LSP can therefore be performed using a simple equation expressed in equation (1). However, the position of the LSP parameter of $P_n$ order on the low-order side of the wideband LSP is determined with respect to the entire wideband signal including the LSP parameter of ($P_w-P_n$) order on the high-order side, and therefore the position does not necessarily correspond to the LSP parameter of $P_n$ order of the narrowband LSP. Therefore, high conversion efficiency (which can also be referred to as predictive accuracy when we consider the wideband LSP to be predicted from the narrowband LSP) cannot be obtained in the conversion expressed in equation (1). The encoding performance of a wideband LSP encoding apparatus designed based on equation (1) bears improvements.

Non-patent Document 1, for example, describes a method of calculating optimum conversion coefficient β(i) for each order as shown in equation (2) below using an algorithm for optimizing the conversion coefficient, instead of setting 0.5 for the conversion coefficient by which the narrowband LSP parameter of the ith order of equation (1) is multiplied.

$$fw_n(i)=\alpha(i)\times L(i)+\beta(i)\times fn_n(i) \quad (2)$$

In the equation, fw_n(i) is the wideband quantized LSP parameter of the ith order in the nth frame, α(i)×L(i) is the element of the ith order of the vector in which the prediction error signal is quantized (α(i) is the weighting coefficient of the ith order), L(i) is the LSP prediction residual vector, β(i) is the weighting coefficient for the predicted wideband LSP, and fn_n(i) is the narrowband LSP parameter in the nth frame. By optimizing the conversion coefficient in this way, it is possible to realize higher encoding performance with an LSP encoding apparatus which has the same configuration as the one described in Patent Document 2.

According to Non-patent Document 2, for example, the analysis order of the LSP parameter is appropriately about 8th to 10th for a narrowband speech signal in the frequency range of 3 to 4 kHz, and is appropriately about 12th to 16th for a wideband speech signal in the frequency range of 5 to 8 kHz.

Patent Document 1: Japanese Patent Application Laid-Open No. 2003-241799

Patent Document 2: Japanese Patent No. 3134817

Non-patent Document 1: K. Koishida et al., "Enhancing MPEG-4 CELP by jointly optimized inter/intra-frame LSP predictors," IEEE Speech Coding Workshop 2000, Proceeding, pp. 90-92, 2000.

Non-patent Document 2: S. Saito and K. Nakata, Foundations of Speech Information Processing, Ohmsha, 30 Nov. 1981, p. 91.

DISCLOSURE OF INVENTION

Problems to be Solved by the Invention

However, the position of the LSP parameter of $P_n$ order on the low-order side of the wideband LSP is determined with respect to the entire wideband signal. Therefore, when the analysis order of the narrowband LSP is 10th, and the analysis order of the wideband LSP is 16th, such as in Non-patent Document 2, it is often the case that 8 or less LSP parameters out of the 16th-order wideband LSPs exist on the low-order side (which corresponds to the band in which the 1st through 10th narrowband LSP parameters exist). Therefore, in the conversion using equation (2), there is no longer a one-to-one correlation with the narrowband LSP parameters (10th order) in the low-order side of the wideband LSP parameters (16th order). In other words, when the 10th-order component of the wideband LSP exists in band exceeding 4 kHz, the 10th-order component of the wideband LSP becomes correlated with the 10th-order component of the narrowband LSP that exists in band of 4 kHz or lower, which results in an inappropriate correlation between the wideband LSP and the narrowband LSP. Therefore, the encoding performance of a wideband LSP encoding apparatus designed based on equation (2) bears improvements.

It is therefore an object of the present invention to provide a scalable encoding apparatus and scalable encoding method that are capable of increasing the conversion performance (or predictive accuracy when we consider a wideband LSP to be predicted from a narrowband LSP) from a narrowband LSP to a wideband LSP and realizing bandwidth-scalable LSP encoding with high performance.

Means for Solving the Problem

The scalable encoding apparatus of the present invention is a scalable encoding apparatus that obtains a wideband LSP parameter from a narrowband LSP parameter, the scalable encoding apparatus having: a first conversion section that converts the narrowband LSP parameter into autocorrelation coefficients; an up-sampling section that up-samples the autocorrelation coefficients; a second conversion section that converts the up-sampled autocorrelation coefficients into an LSP parameter; and a third conversion section that converts frequency band of the LSP parameter into wideband to obtain the wideband LSP parameter.

Advantageous Effect of the Invention

According to the present invention, it is possible to increase the performance of conversion from narrowband LSPs to wideband LSPs and realize bandwidth-scalable LSP encoding with high performance.

BEST MODE FOR CARRYING OUT THE INVENTION

Embodiments of the present invention will be described in detail below with reference to the accompanying drawings.

Figure 1:
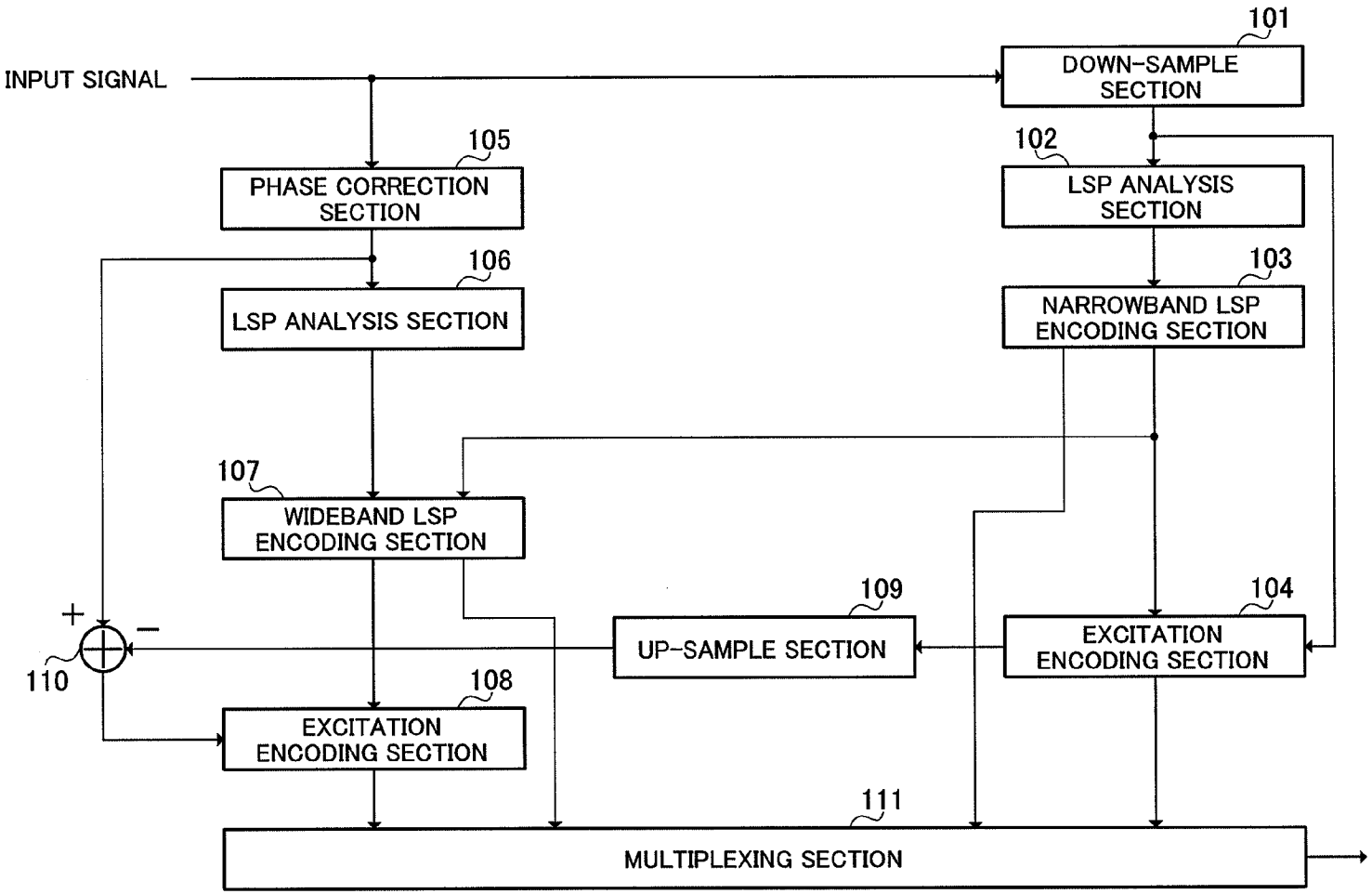
FIG. 1 is a block diagram showing the main configuration of a scalable encoding apparatus according to one embodiment of the present invention.

FIG. 1 is a block diagram showing the main configuration of the scalable encoding apparatus according to one embodiment of the present invention.

The scalable encoding apparatus according to this embodiment is provided with: down-sample section 101; LSP analysis section (for narrowband) 102; narrowband LSP encoding section 103; excitation encoding section (for narrowband) 104; phase correction section 105; LSP analysis section (for wideband) 106; wideband LSP encoding section 107; excitation encoding section (for wideband) 108; up-sample section 109; adder 110; and multiplexing section 111.

Down-sample section 101 carries out down sampling processing on an input speech signal and outputs a narrowband signal to LSP analysis section (for narrowband) 102 and excitation encoding section (for narrowband) 104. The input speech signal is a digitized signal and is subjected to HPF, background noise suppression processing, or other pre-processing as necessary.

LSP analysis section (for narrowband) 102 calculates an LSP (Line Spectrum Pair) parameter with respect to the narrowband signal inputted from down-sample section 101 and outputs the LSP parameter to narrowband LSP encoding section 103. More specifically, after LSP analysis section (for narrowband) 102 calculates a series of autocorrelation coefficients from the narrowband signal and converts the autocorrelation coefficients to LPCs (Linear Prediction Coefficients), LSP analysis section 102 calculates a narrowband LSP parameter by converting the LPCs to LSPs (the specific procedure of conversion from the autocorrelation coefficients to LPCs, and from the LPCs to LSPs is described, for example, in ITU-T Recommendation G.729 (section 3.2.3: LP to LSP conversion)). At this time, LSP analysis section (for narrowband) 102 applies a window referred to as a lag window to the autocorrelation coefficients in order to reduce the truncation error of the autocorrelation coefficients (regarding the lag window, refer to, for example, T. Nakamizo, "Signal analysis and system identification," Modern Control Series, Corona, p. 36, Ch.2.5.2).

The narrowband quantized LSP parameter obtained by encoding the narrowband LSP parameter inputted from LSP analysis section (for narrowband) 102 is outputted by narrowband LSP encoding section 103 to wideband LSP encoding section 107 and excitation encoding section (for narrowband) 104. Narrowband LSP encoding section 103 also outputs encoding data to multiplexing section 111.

Excitation encoding section (for narrowband) 104 converts the narrowband quantized LSP parameter inputted from narrowband LSP encoding section 103 into a series of linear prediction coefficients, and a linear prediction synthesis filter is created using the obtained linear prediction coefficients. Excitation encoding section 104 calculates an auditory weighting error between a synthesis signal synthesized using the linear prediction synthesis filter and a narrowband input signal separately inputted from down-sample section 101, and performs excitation parameter encoding that minimizes the auditory weighting error. The obtained encoding information is outputted to multiplexing section 111. Excitation encoding section 104 generates a narrowband decoded speech signal and outputs the narrowband decoded speech signal to up-sample section 109.

For narrowband LSP encoding section 103 or excitation encoding section (for narrowband) 104, it is possible to apply a circuit commonly used in a CELP-type speech encoding apparatus which uses LSP parameters and use the techniques described, for example, in Patent Document 2 or ITU-T Recommendation G.729.

The narrowband decoded speech signal synthesized by excitation encoding section 104 is inputted to up-sample section 109, and the narrowband decoded speech signal is up-sampled and outputted to adder 110.

Adder 110 receives the phase-corrected input signal from phase correction section 105 and the up-sampled narrowband decoded speech signal from up-sample section 109, calculates a differential signal for both of the received signals, and outputs the differential signal to excitation encoding section (for wideband) 108.

Phase correction section 105 corrects the difference (lag) in phase that occurs in down-sample section 101 and up-sample section 109. When down-sampling and up-sampling are performed by a linear phase low-pass filter and through sample decimation/zero point insertion, phase correction section 105 delays the input signal by an amount corresponding to the lag that occurs due to the linear phase low-pass filter, and outputs the delayed signal to LSP analysis section (for wideband) 106 and adder 110.

LSP analysis section (for wideband) 106 performs LSP analysis of the wideband signal outputted from phase correction section 105 and outputs the obtained wideband LSP parameter to wideband LSP encoding section 107. More specifically, LSP analysis section (for wideband) 106 calculates a series of autocorrelation coefficients from the wideband signal, calculates a wideband LSP parameter by converting the autocorrelation coefficients to LPCs, and converting the LPCs to LSPs. LSP analysis section (for wideband) 106 at this time applies a lag window to the autocorrelation coefficients in the same manner as LSP analysis section (for narrowband) 102 in order to reduce the truncation error of the autocorrelation coefficients.

Figure 2:
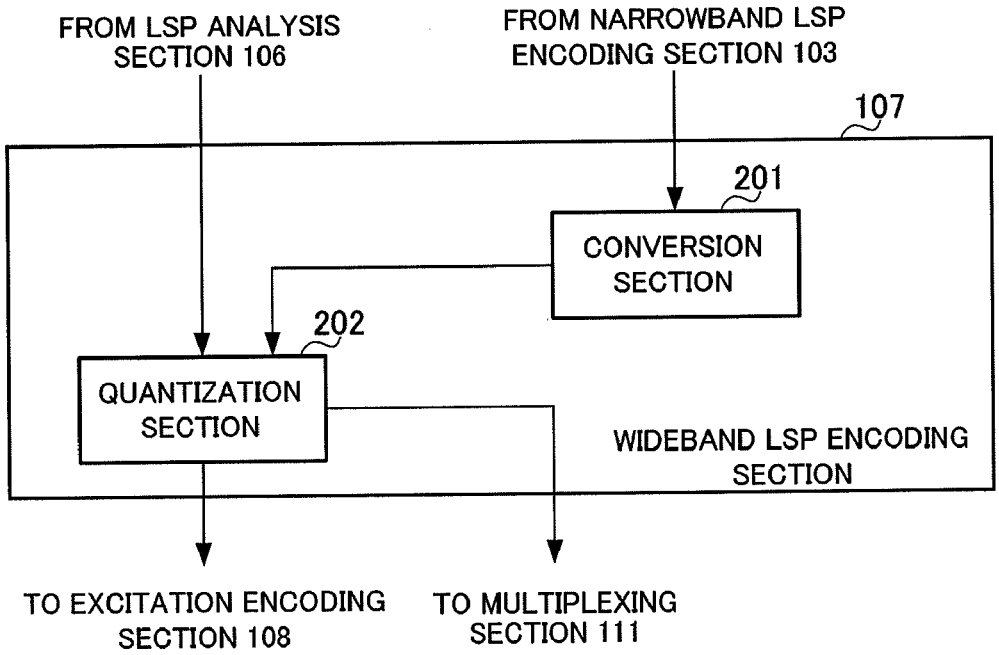
FIG. 2 is a block diagram showing the main configuration of a wideband LSP encoding section according to the above-described embodiment.

As shown in FIG. 2, wideband LSP encoding section 107 is provided with conversion section 201 and quantization section 202. Conversion section 201 converts the narrowband quantized LSPs inputted from narrowband LSP encoding section 103, calculates predicted wideband LSPs, and outputs the predicted wideband LSPs to quantization section 202. A detailed configuration and operation of conversion section 201 will be described later. Quantization section 202 encodes the error signal between the wideband LSPs inputted from LSP analysis section (for wideband) 106 and the predicted wideband LSPs inputted from the LSP conversion section using vector quantization or another method, outputs the obtained wideband quantized LSPs to excitation encoding section (for wideband) 108, and outputs the obtained code information to multiplexing section 111.

Excitation encoding section (for wideband) 108 converts the quantized wideband LSP parameter inputted from wideband LSP encoding section 107 into a series of linear prediction coefficients and creates a linear prediction synthesis filter using the obtained linear prediction coefficients. The auditory weighting error between the synthesis signal synthesized using the linear prediction synthesis filter and the phase-corrected input signal is calculated, and excitation parameters that minimizes the auditory weighting error are determined. More specifically, the error signal between the wideband input signal and the up-sampled narrowband decoded signal is separately inputted to excitation encoding section 108 from adder 110, the error between the error signal and the decoded signal generated by excitation encoding section 108 is calculated, and excitation parameters are determined so that the auditory-weighted error becomes minimum. The code information of the calculated excitation parameter is outputted to multiplexing section 111. A description of the excitation encoding is disclosed, for example, in K. Koishida et al., "A 16-kbit/s bandwidth scalable audio coder based on the G.729 standard," IEEE Prc. ICASSP 2000, pp. 1149-1152, 2000.

Multiplexing section 111 receives the narrowband LSP encoding information from narrowband LSP encoding section 103, the narrowband signal excitation encoding information from excitation encoding section (for narrowband) 104, the wideband LSP encoding information from wideband LSP encoding section 107, and the wideband signal excitation encoding information from excitation encoding section (for wideband) 108. Multiplexing section 111 multiplexes the information into a bit stream that is transmitted to the transmission path. The bit stream is divided into transmission channel frames or packets according to the specifications of the transmission path. Error protection and error detection code may be added, and interleave processing and the like may be applied in order to increase resistance to transmission path errors.

Figure 3:
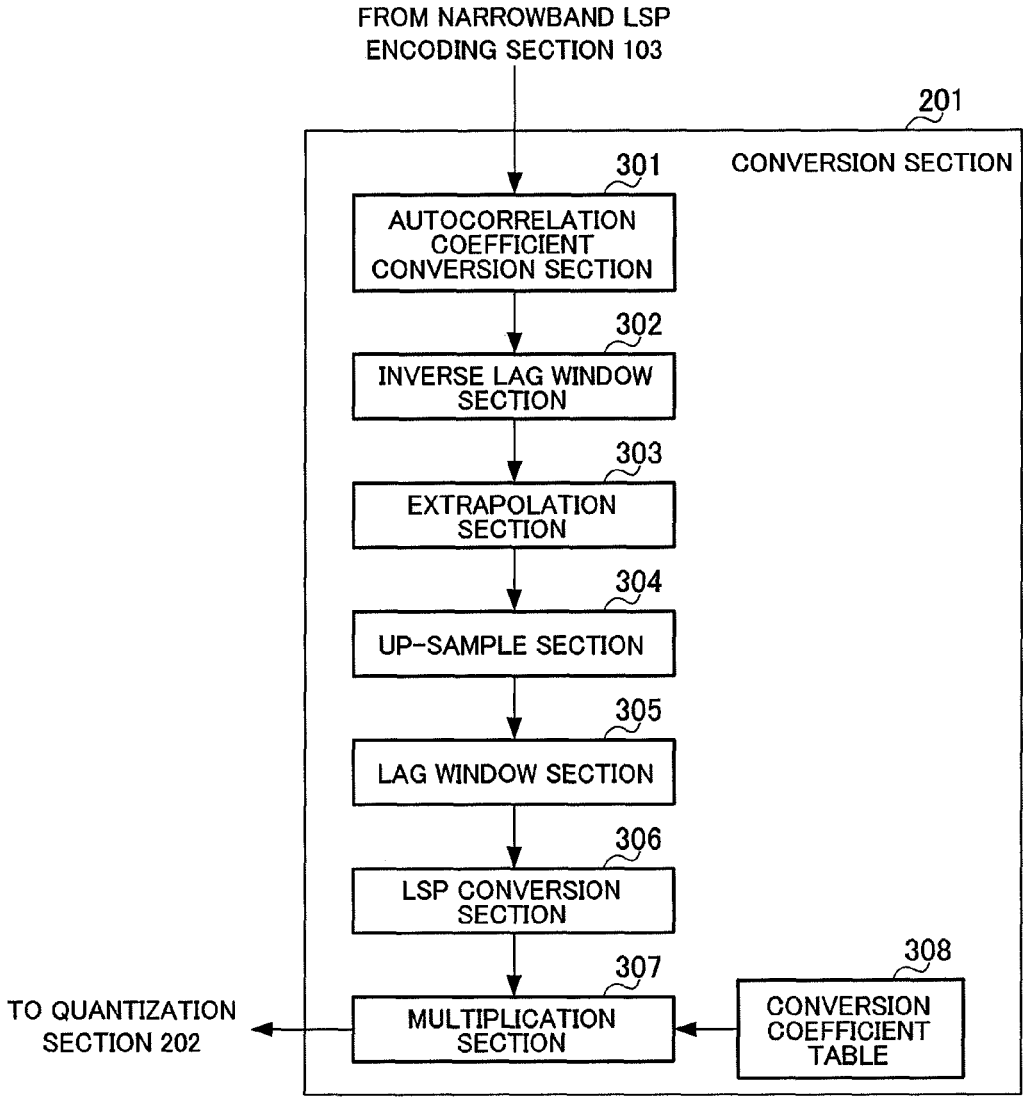
FIG. 3 is a block diagram showing the main configuration of a conversion section according to the above-described embodiment.

FIG. 3 is a block diagram showing the main configuration of conversion section 201 described above. Conversion section 201 is provided with: autocorrelation coefficient conversion section 301; inverse lag window section 302; extrapolation section 303; up-sample section 304; lag window section 305; LSP conversion section 306; multiplication section 307; and conversion coefficient table 308.

Autocorrelation coefficient conversion section 301 converts a series of narrowband LSPs of Mn order into a series of autocorrelation coefficients of Mn order and outputs the autocorrelation coefficients of Mn order to inverse lag window section 302. More specifically, autocorrelation coefficient conversion section 301 converts the narrowband quantized LSP parameter inputted by narrowband LSP encoding section 103 into a series of LPCs (linear prediction coefficients), and then converts the LPCs into autocorrelation coefficients.

The conversion from LSPs to LPCs is disclosed in, for example, P. Kabal and R. P. Ramachandran, "The Computation of Line Spectral Frequencies Using Chevyshev Polynomials," IEEE Trans. on Acoustics, Speech, and Signal Processing, Vol. ASSP-34, No. 6, December 1986 ("LSF" in this publication corresponds to "LSP" in this embodiment). The specific procedure of conversion from LSPs to LPCs is also disclosed in, for example, ITU-T Recommendation G.729 (section 3.2.6 LSP to LP conversion).

The conversion from LPCs to autocorrelation coefficients is performed using the Levinson-Durbin algorithm (see, for example, T. Nakamizo, "Signal analysis and system identification," Modern Control Series, Corona, p. 71, Ch. 3.6.3). This conversion is specifically performed using Equation (3).

$$\begin{cases} R_{m+1} = -\sigma_m^2 k_{m+1} - \sum_{i=1}^{m} a_i^{(m)} R_{m+1-i} \\ \sigma_{m+1}^2 = (1 - k_{m+1}^2)\sigma_m^2 \end{cases} \tag{3}$$

$R_m$: autocorrelation coefficient of mth order $\sigma_m^2$: residual power of mth-order linear prediction (square mean value of residual error)

$k_m$: reflection coefficient of mth order $a_i^{(m)}$: linear prediction coefficient of ith order (ith) in mth-order linear prediction Inverse lag window section 302 applies a window (inverse lag window) which has an inverse characteristic of the lag window applied to the autocorrelation coefficients, to the inputted autocorrelation coefficients. As described above, since the lag window is applied to the autocorrelation coefficients when the autocorrelation coefficients are converted into LPCs in LSP analysis section (for narrowband) 102, the lag window is still applied to the autocorrelation coefficients that are inputted from autocorrelation coefficient conversion section 301 to inverse lag window section 302. Therefore, inverse lag window section 302 applies the inverse lag window to the inputted autocorrelation coefficients in order to increase the accuracy of the extrapolation processing described later, reproduces the autocorrelation coefficients prior to application of the lag window in LSP analysis section (for narrowband) 102, and outputs the results to extrapolation section 303.

Autocorrelation coefficients having order exceeding the Mn order are not encoded in the narrowband encoding layer, and autocorrelation coefficients having order exceeding the Mn order must therefore be calculated only from information up to the Mn order. Therefore, extrapolation section 303 performs extrapolation processing on the autocorrelation coefficients inputted from inverse lag window section 302, extends the order of the autocorrelation coefficients, and outputs the order-extended autocorrelation coefficients to up-sample section 304. Specifically, extrapolation section 303 extends the Mn-order autocorrelation coefficients to (Mn+Mi) order. The reason for performing this extrapolation processing is that the autocorrelation coefficients of a higher order than the Mn order is necessary in the up-sampling processing described later. In order to reduce the truncation error that occurs during the up-sampling processing described later, the analysis order of the narrowband LSP parameter in this embodiment is made ½ or more of the analysis order of the wideband LSP parameter. Specifically, the (Mn+Mi) order is made less than twice the Mn order. Extrapolation section 303 recursively calculates autocorrelation coefficients of (Mn+1) to (Mn+Mi) order by setting the reflection coefficients in the portion that exceeds the Mn order to zero in the Levinson-Durbin algorithm (equation (3)). Equation (4) is obtained when the reflection coefficients in the portion that exceeds the Mn order in equation (3) are set to zero.

$$\begin{cases} R_{m+1} = -\sum_{i=1}^{m} a_i^{(m)} R_{m+1-i} \\ \sigma_{m+1}^2 = \sigma_m^2 \end{cases} \tag{4}$$

Equation (4) can be expanded in the same manner as equation (5). As shown in equation (5), it is apparent that the autocorrelation coefficient $R_{m+1}$ obtained when the reflection coefficient is set to zero express the relationship between the predicted value $[\hat{x}_{t+m+1}]$ obtained by linear prediction from the input signal temporal waveform $x_{t+m+1-i}$ (i=1 to m) and the input signal temporal waveform $x_t$. In other words, extrapolation section 303 performs extrapolation processing on the autocorrelation coefficients using linear prediction. By performing this type of extrapolation processing, it is possible to obtain autocorrelation coefficients that can be converted into a series of stable LPCs through the up-sampling processing described later.

$$R_{m+1} = -\sum_{i=1}^{m} a_i^{(m)} R_{m+1-i} = -\sum_{i=1}^{m} a_i^{(m)} \sum_t x_t x_{t+m+1-i} \tag{5}$$

-continued $$= -\sum_{i=1}^{m} \sum_t a_i^{(m)} x_t x_{t+m+1-i} = -\sum_t \sum_{i=1}^{m} a_i^{(m)} x_t x_{t+m+1-i}$$

$$= -\sum_t x_t \sum_{i=1}^{m} a_i^{(m)} x_{t+m+1-i} = \sum_t x_t \hat{x}_{t+m+1}$$

Up-sample section 304 performs up-sampling processing in an autocorrelation domain that is equivalent to up-sampling processing in a time domain on the autocorrelation coefficient inputted from the extrapolation section, that is, the autocorrelation coefficients having order extending to the (Mn+Mi) order, and obtains the autocorrelation coefficients of Mw order. The up-sampled autocorrelation coefficients are outputted to lag window section 305. The up-sampling processing is performed using an interpolation filter (polyphase filter, FIR filter, or the like) that convolves a sinc function. The specific procedure of up-sampling processing of the autocorrelation coefficients is described below.

Interpolation of a continuous signal u(t) from a discretized signal x(nΔt) using the sinc function can be expressed as equation (6). Up-sampling for doubling the sampling frequency of u(t) is expressed in equations (7) and (8).

$$u(t) = \sum_{n=-\infty}^{+\infty} x(n\Delta t) \cdot \frac{\sin\left(\frac{t}{\Delta t} - n\right)\pi}{\left(\frac{t}{\Delta t} - n\right)\pi} \tag{6}$$

$$u(2i) = \sum_{n=-\infty}^{+\infty} x(i-n) \cdot \mathrm{sinc}(n\pi) = x(i) \tag{7}$$

$$u(2i+1) = \sum_{n=-\infty}^{+\infty} x(i-n) \cdot \mathrm{sinc}\left(n + \frac{1}{2}\right)\pi \tag{8}$$

Equation (7) expresses points of even-number samples obtained by up-sampling, and x(i) prior to up-sampling becomes u(2i) as is.

Equation (8) expresses points of odd-number samples obtained by up-sampling, and u(2i+1) can be calculated by convolving a sinc function with x(i). The convolution processing can be expressed by the sum of products of x(i) obtained by inverting the time axis and the sinc function. The sum of products is obtained using neighboring points of x(i). Therefore, when the number of data required for the sum of products is 2N+1, x(i−N) to x(i+N) are needed in order to calculate the point u(2i+1). It is therefore necessary in this up-sampling processing that the time length of data before up-sampling be longer than the time length of data after up-sampling. Therefore, in this embodiment, the analysis order per bandwidth for the wideband signal is relatively smaller than the analysis order per bandwidth for the narrowband signal.

The up-sampled autocorrelation coefficient R(j) can be expressed by equation (9) using u(i) obtained by up-sampling x(i).

$$R(j) = \sum_{l=-\infty}^{+\infty} u(l) \cdot u(l+j) \tag{9}$$

-continued $$= \sum_{i=-\infty}^{+\infty} u(2i)\cdot u(2i+j) + \sum_{i=-\infty}^{+\infty} u(2i+1)\cdot u(2i+1+j)$$

Equations (10) and (11) are obtained by substituting equations (7) and (8) into equation (9) and simplifying the equations. Equation (10) indicates points of even-number samples, and equation (11) indicates points of odd-number samples.

$$R(2k) = r(k) + \sum_{m=-\infty}^{+\infty}\sum_{n=-\infty}^{+\infty} r(k-n+m)\cdot \mathrm{sinc}\left(m+\frac{1}{2}\right)\pi\cdot \mathrm{sinc}\left(n+\frac{1}{2}\right)\pi \tag{10}$$

$$R(2k+1) = \sum_{m=-\infty}^{+\infty} (r(k-m) + r(k+1+m))\cdot \mathrm{sinc}\left(m+\frac{1}{2}\right)\pi \tag{11}$$

The term r(j) in equations (10) and (11) herein is the autocorrelation coefficient of un-up-sampled x(i) It is therefore apparent that, when un-up-sampled autocorrelation coefficient r(j) is up-sampled to R(j) using equations (10) and (11), this is equivalent to calculation of the autocorrelation coefficient by using u(i) which is up-sampled x(i) in the time domain. In this way, up-sample section 304 performs up-sampling processing in the autocorrelation domain that is equivalent to up-sampling processing in the time domain, thereby making it possible to suppress errors generated through up-sampling to a minimum.

Besides using the processing expressed in equations (6) through (11), the up-sampling processing may also be approximately performed using the processing described in ITU-T Recommendation G.729 (section 3.7), for example. In ITU-T Recommendation G.729, cross-correlation coefficients are up-sampled in order to perform a fractional-accuracy pitch search in pitch analysis. For example, normalized cross-correlation coefficients are interpolated at ⅓ accuracy (which corresponds to threefold up-sampling).

Lag window section 305 applies a lag window for wideband (for a high sampling rate) to the up-sampled autocorrelation coefficients of Mw order that are inputted from up-sample section 304, and outputs the result to LSP conversion section 306.

LSP conversion section 306 converts the lag-window applied autocorrelation coefficients of Mw order (autocorrelation coefficients in which the analysis order is less than twice the analysis order of the narrowband LSP parameter) into LPCs, and converts the LPCs into LSPs to calculate the LSP parameter of Mw order. A series of narrowband LSPs of Mw order can be thereby obtained. The narrowband LSPs of Mw order are outputted to multiplication section 307.

Multiplication section 307 multiplies the narrowband LSPs of Mw order inputted from LSP conversion section 306 by a set of conversion coefficients stored in conversion coefficient table 308, and converts the frequency band of the narrowband LSPs of Mw order into wideband. By this conversion, multiplication section 307 calculates a series of predicted wideband LSPs of Mw order from the narrowband LSPs of Mw order, and outputs the predicted wideband LSPs to quantization section 202. The conversion coefficients have been described as being stored in conversion coefficient table 308, but the adaptively calculated conversion coefficients may also be used. For example, the ratios of the wideband quantized LSPs to the narrowband quantized LSPs in the immediately preceding frame may be used as the conversion coefficients.

Conversion section 201 thus converts the narrowband LSPs inputted from narrowband LSP encoding section 103 to calculate the predicted wideband LSPs.

Figure 4:
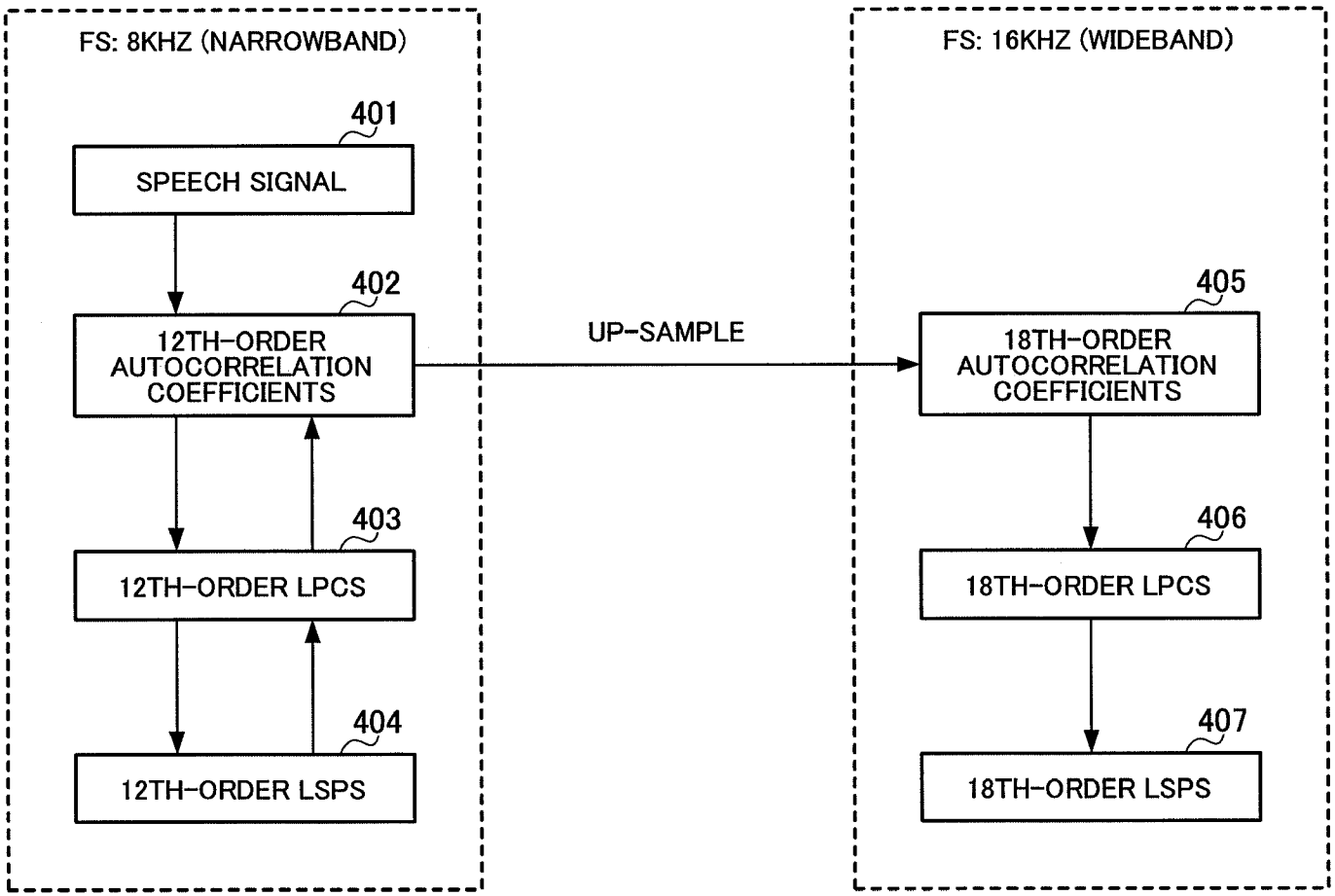
FIG. 4 is a flowchart of the operation of the scalable encoding apparatus according to the above-described embodiment.

The operation flow of the scalable encoding apparatus of this embodiment will next be described using FIG. 4. FIG. 4 shows an example where a narrowband speech signal (8 kHz sampling, Fs: 8 kHz) is subjected to 12th-order LSP analysis, and a wideband speech signal (16 kHz sampling, Fs: 16 kHz) is subjected to 18th-order LSP analysis.

In Fs: 8 kHz (narrowband), a narrowband speech signal (401) is converted into a series of 12th-order autocorrelation coefficients (402), the 12th-order autocorrelation coefficients (402) are converted into a series of 12th-order LPCs (403), and the 12th-order LPCs (403) are converted into a series of 12th-order LSPs (404).

Here, the 12th-order LSPs (404) can be reversibly converted (returned) into the 12th-order LPCs (403), and the 12th-order LPCs (403) can be reversibly converted (returned) into the 12th-order autocorrelation coefficients (402). However, the 12th-order autocorrelation coefficients (402) cannot be returned to the original speech signal (401).

Therefore, in the scalable encoding apparatus according to this embodiment, by performing up-sampling in the autocorrelation domain that is equivalent to up-sampling in the time domain, the autocorrelation coefficients (405) having an Fs value of 16 kHz (wideband) are calculated. In other words, the 12th-order autocorrelation coefficients (402) having an Fs value of 8 kHz are up-sampled into the 18th-order autocorrelation coefficients (405) having an Fs value of 16 kHz.

At an Fs value of 16 kHz (wideband), the 18th-order autocorrelation coefficients (405) are converted into a series of 18th-order LPCs (406), and the 18th-order LPCs (406) are converted into a series of 18th-order LSPs (407). This series of 18th-order LSPs (407) is used as the predicted wideband LSPs.

At an Fs value of 16 kHz (wideband), it is necessary to perform processing that is pseudo-equivalent to calculation of the autocorrelation coefficients based on the wideband speech signal, and therefore, as described above, when up-sampling in the autocorrelation domain is performed, extrapolation processing of the autocorrelation coefficients is performed so that the 12th-order autocorrelation coefficients having an Fs value of 8 kHz are extended to the 18th-order autocorrelation coefficients.

The effect of inverse lag window application by inverse lag window section 302 and extrapolation processing by extrapolation section 303 will next be described using FIGS. 5 and 6.

Figure 5:
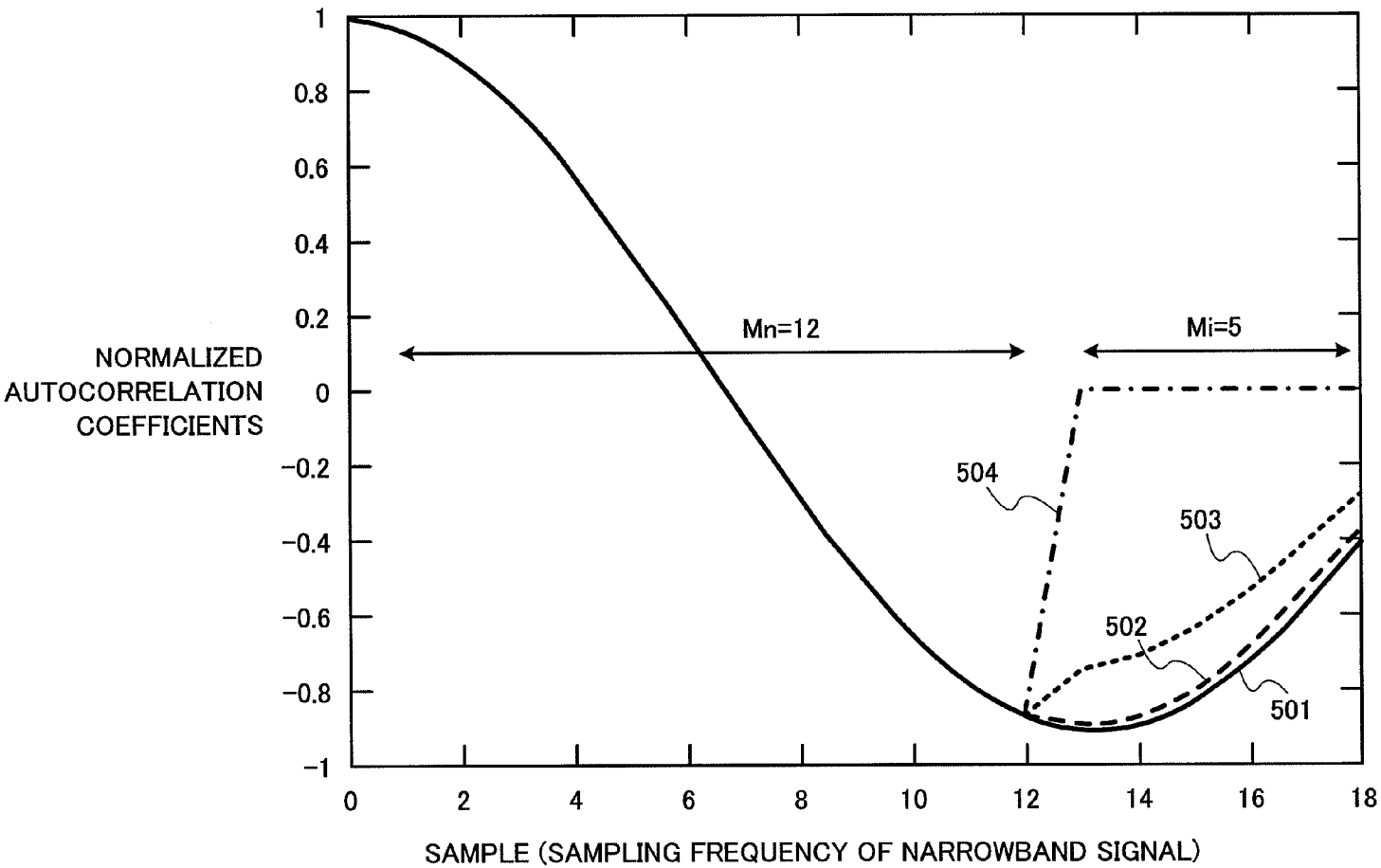
FIG. 5 is a graph showing the autocorrelation coefficients of the (Mn+Mi) order obtained by extending the autocorrelation coefficients of Mn order.

FIG. 5 is a graph showing the autocorrelation coefficients of (Mn+Mi) order obtained by extending the autocorrelation coefficients of Mn order. In FIG. 5, 501 is a series of the autocorrelation coefficients calculated from an actual narrowband input speech signal (low sampling rate), and a series of ideal autocorrelation coefficients. By contrast with this, 502 is a series of the autocorrelation coefficients calculated by performing extrapolation processing after applying the inverse lag window to the autocorrelation coefficients as described in this embodiment. Further, 503 is a series of the autocorrelation coefficients calculated by performing extrapolation processing on the autocorrelation coefficients as is without applying the inverse lag window. In 503, the inverse lag window is applied after extrapolation processing in order to match the scale. It is apparent from the results in FIG. 5 that 503 is more distorted than 502 in the extrapolated portion (portion in which Mi=5). In other words, by performing extrapolation processing after applying the inverse lag window to the autocorrelation coefficient as in this embodiment, it is possible to increase the accuracy of extrapolation processing of the autocorrelation coefficients. In addition, 504 is the autocorrelation coefficients calculated by extending the Mi order of the autocorrelation coefficients by filling zero without performing extrapolation processing as described in this embodiment.

Figure 6:
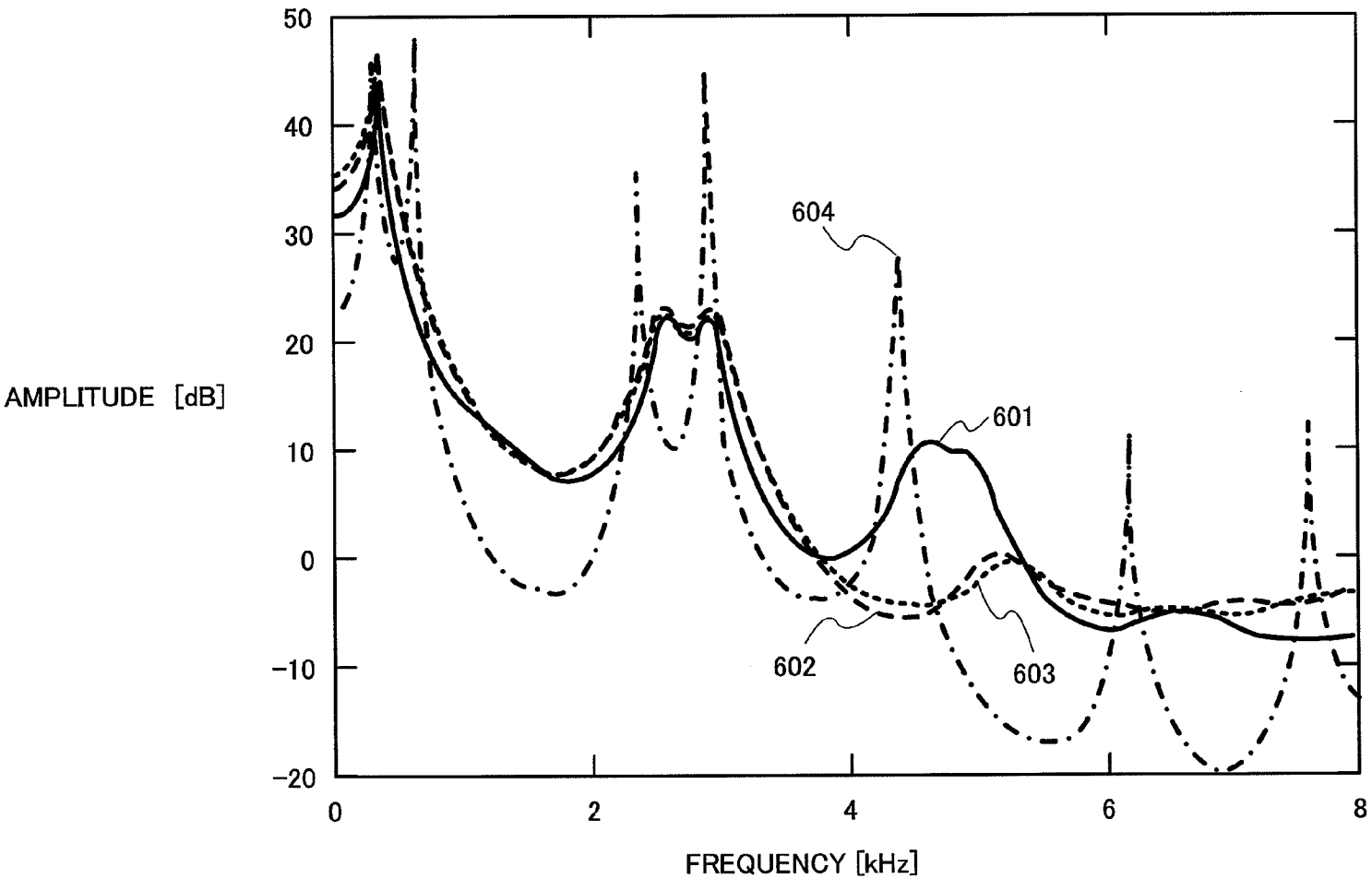
FIG. 6 is a graph showing the LPCs calculated from the autocorrelation coefficients obtained by carrying out up-sampling processing on each of the results in FIG. 5.

FIG. 6 is graph showing the LPC spectral envelope calculated from the autocorrelation coefficients obtained by performing up-sampling processing on the results of FIG. 5. 601 indicates the LPC spectral envelope calculated from a wideband signal that includes the band of 4 kHz and higher. 602 corresponds to 502, 603 corresponds to 503, and 604 corresponds to 504. The results in FIG. 6 show that, when the LPCs are calculated from autocorrelation coefficients that are obtained by up-sampling the autocorrelation coefficients (504) calculated by extending the Mi order by filling zero, the spectral characteristics fall into an oscillation state as indicated by 604. When the Mi order (extended portion) is extended by filling zero in this way, the autocorrelation coefficients cannot be appropriately interpolated (up-sampled), and oscillation therefore occurs when the autocorrelation coefficients are converted into LPCs, and a stable filter cannot be obtained. When the LPCs fall into an oscillation state in this way, it is impossible to convert the LPCs to the LSPs. However, it is apparent that, when the series of LPCs is calculated from the series of autocorrelation coefficients obtained by up-sampling the autocorrelation coefficients whose Mi orders have been extended by performing the extrapolation processing as described in this embodiment, results similar to 602 and 603 are obtained, so that it is possible to obtain the narrowband (less than 4 kHz) component of the wideband signal with high accuracy. In this way, according to this embodiment, it is possible to up-sample the autocorrelation coefficients with high accuracy. In other words, according to this embodiment, by performing extrapolation processing as expressed in equations (4) and (5), it is possible to perform appropriate up-sampling processing on the autocorrelation coefficients and obtain a series of stable LPCs.

Figure 7:
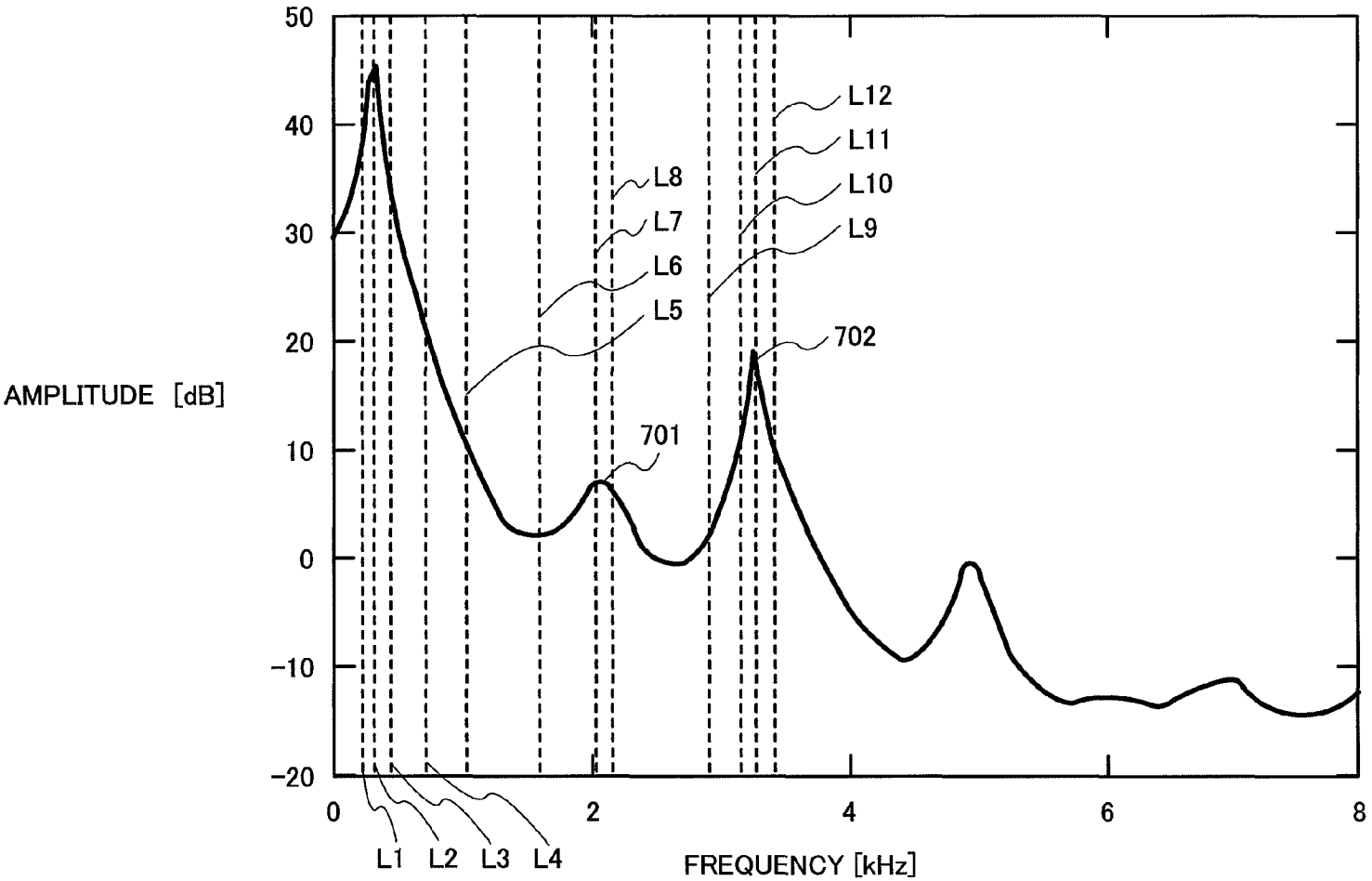
FIG. 7 is a graph of LSP simulation results (LSP in which a narrowband speech signal having an Fs value of 8 kHz is subjected to 12th-order analysis)
Figure 8:
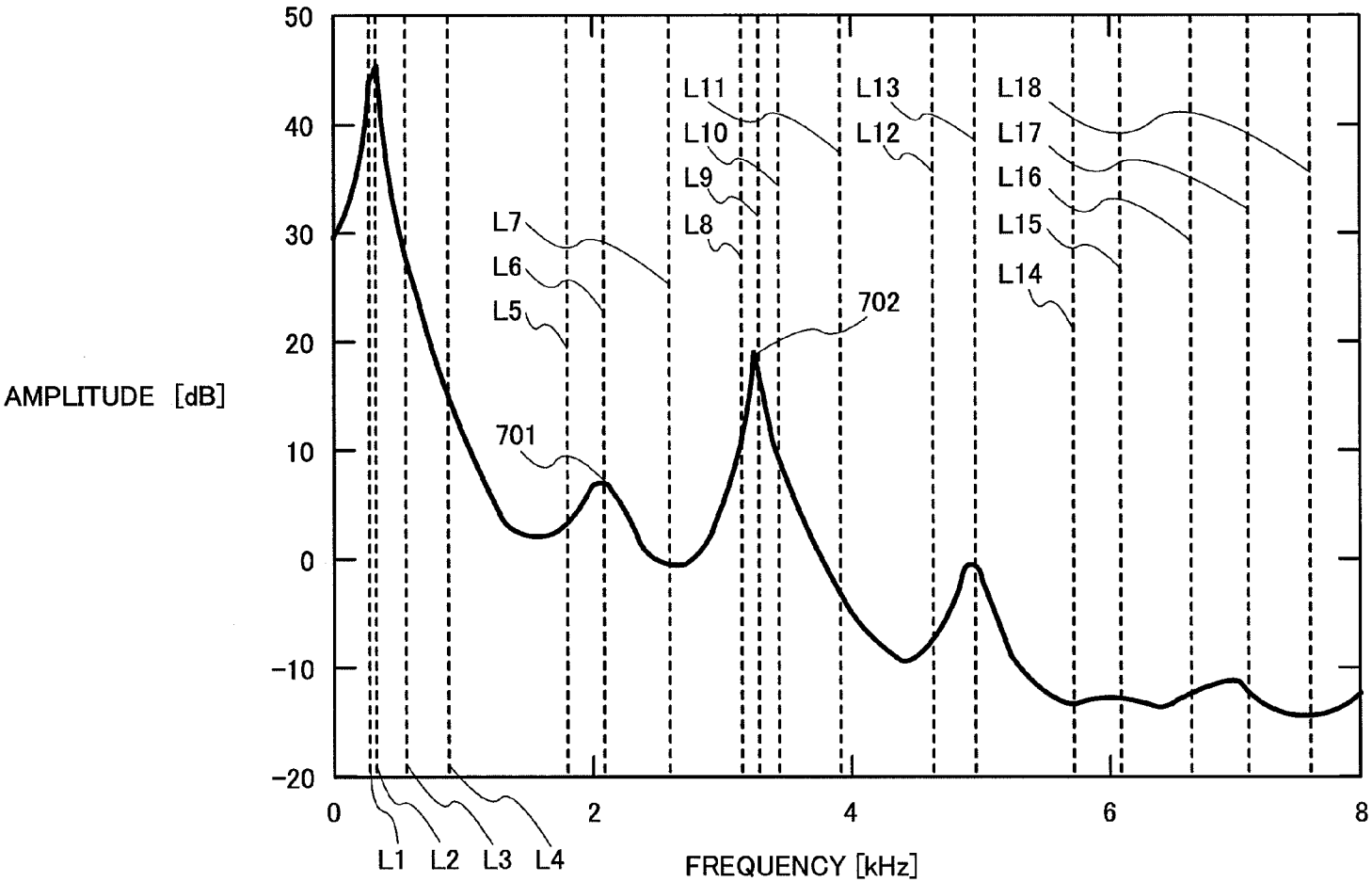
FIG. 8 is a graph of LSP simulation results (when LSPs in which a narrowband speech signal subjected to 12th-order analysis is converted to 18th-order LSPs having an Fs value of 16 kHz by the scalable encoding apparatus shown in FIG. 1)
Figure 9:
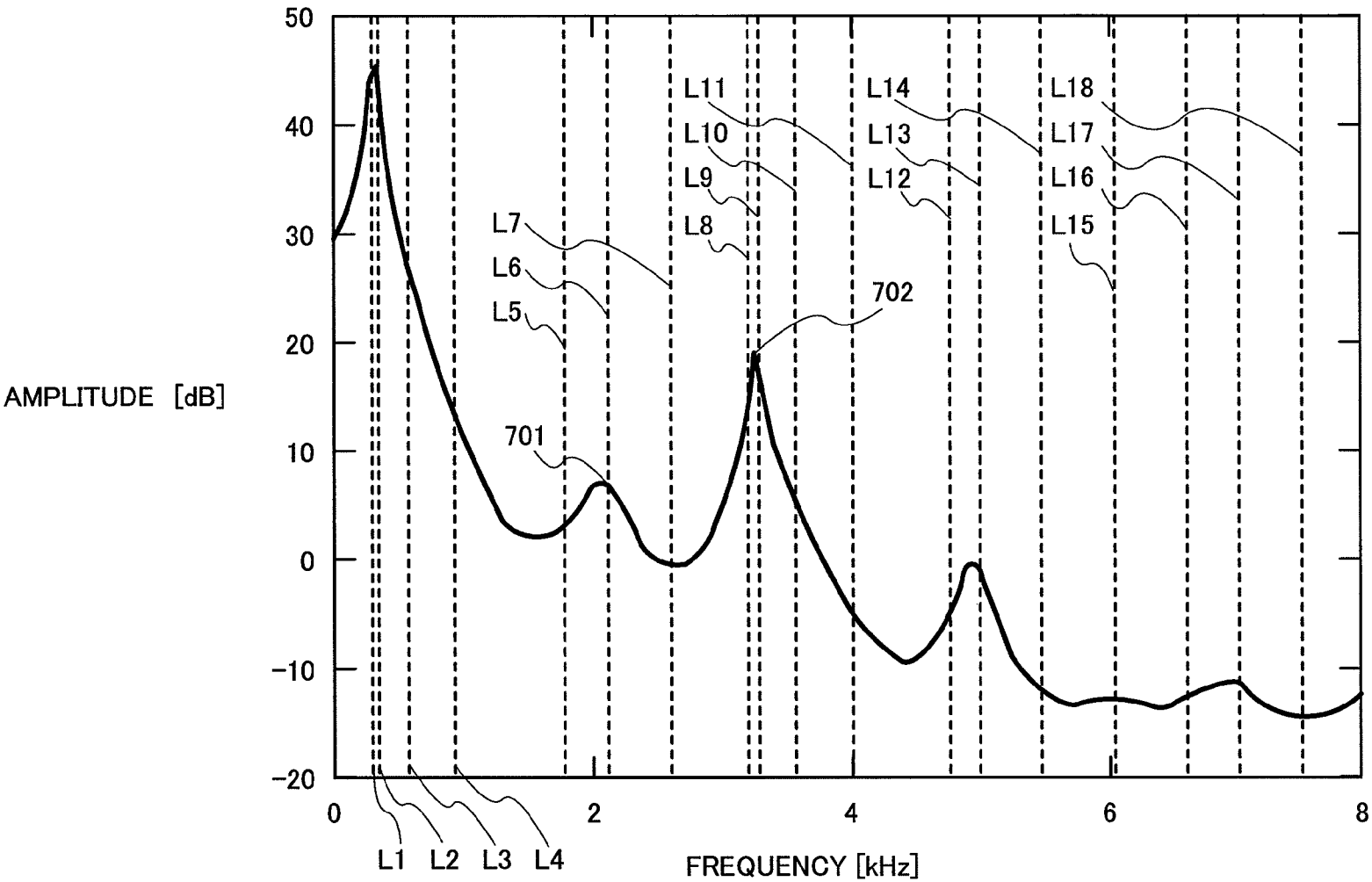
FIG. 9 is a graph of LSP simulation results (LSPs in which a wideband speech signal is subjected to 18th-order analysis).

FIGS. 7 through 9 show LSP simulation results. FIG. 7 shows the LSPs when the narrowband speech signal having an Fs value of 8 kHz is subjected to 12th-order analysis. FIG. 8 shows a case where the LSPs when the narrowband speech signal is subjected to 12th-order analysis is converted into 18th-order LSPs having an Fs value of 16 kHz by the scalable encoding apparatus shown in FIG. 1. FIG. 9 shows the LSPs when the wideband speech signal is subjected to 18th-order analysis. In FIGS. 7 through 9, the solid line indicates the spectral envelope of the input speech signal (wideband), and the dashed lines indicate LSPs. This spectral envelope is the "n" portion of the word "kanri" ("management" in English) when the phrase "kanri sisutemu" ("management system" in English) is spoken by a female voice. In the recent CELP scheme, a CELP scheme with approximately 10th to 14th analysis order for narrowband and with approximately 16th to 20th analysis order for wideband is often used. Therefore, the narrowband analysis order in FIG. 7 is set to 12th, and the wideband analysis order in FIGS. 8 and 9 is set to 18th.

FIG. 7 and FIG. 9 will first be compared. When the relationship between LSPs having the same order in FIGS. 7 and 9 is focused on, for example, the 8th-order LSP (L8) among the LSPs (L1 through L12) in FIG. 7 is near the spectral peak 701 (second spectral peak from the left) On the other hand, the 8th-order LSP (L8) in FIG. 9 is near spectral peak 702 (third spectral peak from the left). In other words, LSPs that have the same order are in completely different positions between FIGS. 7 and 9. It can therefore be considered inappropriate to directly correlate the LSPs of the narrowband speech signal subjected to 12th-order analysis with the LSPs of the wideband speech signal subjected to 18th-order analysis.

However, when FIGS. 8 and 9 are compared, it is apparent that LSPs having the same order are generally well correlated with each other. Particularly in low frequency band of 3.5 kHz or less, good correlation can be obtained. In this way, according to this embodiment, it is possible to convert a narrowband (low sampling frequency) LSP parameter of arbitrary order into a wideband (high sampling frequency) LSP parameter of arbitrary order with high accuracy.

As described above, the scalable encoding apparatus according to this embodiment obtains narrowband and wideband quantized LSP parameters that have scalability in the frequency axis direction.

The scalable encoding apparatus according to the present invention can also be provided in a communication terminal apparatus and a base station apparatus in a mobile communication system, and it is thereby possible to provide a communication terminal apparatus and base station apparatus that have the same operational effects as the effects described above.

In the above-described embodiment, the example has been described where up-sample section 304 performs up-sampling processing for doubling the sampling frequency. However, up-sampling processing in the present invention is not limited to the processing for doubling the sampling frequency. Specifically, the up-sampling processing may make the sampling frequency n times (where n is a natural number equal to 2 or higher). In the case of up-sampling for making the sampling frequency n times, the analysis order of the narrowband LSP parameter in the present invention is set to 1/n or more of the analysis order of the wideband LSP parameter, that is, the (Mn+Mi) order is set to less than n times of Mn order.

In the above-described embodiment, the case has been described where the LSP parameter is encoded, but the present invention is also applicable to an ISP (Immitannce Spectrum Pairs) parameter.

Further, in the above-described embodiment, the case has been described where there are two layers of band-scalable encoding, that is, an example where band-scalable encoding involves two frequency band of narrowband and wideband. However, the present invention is also applicable to band-scalable encoding or band-scalable decoding that involves three or more frequency band (layers).

Separately from lag window application, the autocorrelation coefficients are generally subjected to processing known as White-noise Correction (as processing that is equivalent to adding a faint noise floor to an input speech signal, the autocorrelation coefficient of 0th order is multiplied by a value slightly larger than 1 (1.0001, for example), or all autocorrelation coefficients that are other than 0th order are divided by a number slightly larger than 1 (1.0001, for example). There is no description of White-noise Correction in this embodiment, but White-noise Correction is generally included in the lag window application processing (specifically, lag window coefficients that is subjected to White-noise Correction are used as the actual lag window coefficients). White-noise Correction may thus be included in the lag window application processing in the present invention as well.

Further, in the above-described embodiment, the case has been described as an example where the present invention is configured with hardware, but the present invention is capable of being implemented by software.

Furthermore, each function block used to explain the above-described embodiment is typically implemented as an LSI constituted by an integrated circuit. These may be individual chips or may be partially or totally contained on a single chip.

Furthermore, here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-258924, filed on Sep. 6, 2004, the entire content of which is expressly incorporated by reference herein.

INDUSTRIAL APPLICABILITY

The scalable encoding apparatus and scalable encoding method according to the present invention can be applied to a communication apparatus in a mobile communication system and a packet communication system using Internet Protocol.

The invention claimed is:

1. A scalable encoding apparatus that obtains a wideband line spectrum pair parameter from a narrowband line spectrum pair parameter, the scalable encoding apparatus comprising:

a first convertor that converts the narrowband line spectrum pair parameter into a series of autocorrelation coefficients;

an up-sampler that up-samples the series of autocorrelation coefficients;

a second convertor that converts the up-sampled series of autocorrelation coefficients into a line spectrum pair parameter; and a third convertor that converts the line spectrum pair parameter into a series of wideband line spectrum pairs by multiplying the line spectrum pair parameter by a set of conversion coefficients stored in a table, wherein the up-sampler performs up-sampling in an autocorrelation domain that is equivalent to up-sampling in a time domain.

2. The scalable encoding apparatus according to claim 1, wherein:

the up-sampler increases a sampling frequency of the series of autocorrelation coefficients by a factor of at least n, n being an integer of at least 2; and the second convertor converts the series of autocorrelation coefficients of an analysis order which is less than n times of an analysis order of the narrowband line spectrum pair parameter into the line spectrum pair parameter.

3. The scalable encoding apparatus according to claim 1, further comprising an extrapolator that performs extrapolation processing to extend an order of the series of autocorrelation coefficients.

4. The scalable encoding apparatus according to claim 3, wherein the extrapolator performs extrapolation processing in which an analysis order of the narrowband line spectrum pair parameter is made ½ of an analysis order of the wideband line spectrum pair parameter.

5. The scalable encoding apparatus according to claim 1, further comprising a window applier that applies, to the series of autocorrelation coefficients, a window which has an inverse characteristic of a lag window that is applied to the narrowband line spectrum pair parameter.

6. The scalable encoding apparatus according to claim 1, wherein the scalable encoding apparatus is included in a communication terminal apparatus.

7. The scalable encoding apparatus according to claim 1, wherein the scalable encoding apparatus is included in a base station apparatus.

8. The scalable encoding apparatus according to claim 1, wherein the first convertor converts the narrowband line spectrum pair parameter into the series of autocorrelation coefficients by converting the narrowband line spectrum pair parameter into a series of linear prediction coefficients and converting the series of linear prediction coefficients into the series of autocorrelation coefficients.

9. A scalable encoding method that obtains a wideband line spectrum pair parameter from a narrowband line spectrum pair parameter, the scalable encoding method being performed with an encoder, the scalable encoding method comprising:

converting, with a first convertor, the narrowband line spectrum pair parameter into a series of autocorrelation coefficients;

up-sampling, with an up-sampler, the series of autocorrelation coefficients;

converting, with a second convertor, the up-sampled series of autocorrelation coefficients into a line spectrum pair parameter; and converting, with a third convertor, the line spectrum pair parameter into a series of wideband line spectrum pairs by multiplying the line spectrum pair parameter by a set of conversion coefficients stored in a table, wherein the series of autocorrelation coefficients are up-sampled in an autocorrelation domain that is equivalent to up-sampling in a time domain.

10. The scalable encoding method according to claim 9, wherein the up-sampler increases a sampling frequency of the series of autocorrelation coefficients by a factor of at least n, n being an integer of at least 2; and the second convertor converts the series of autocorrelation coefficients of an analysis order which is less than n times of an analysis order of the narrowband line spectrum pair parameter into the line spectrum pair parameter.

11. The scalable encoding method according to claim 9, further comprising:

performing, with an extrapolator, extrapolation processing to extend an order of the series of autocorrelation coefficients.

12. The scalable encoding method according to claim 11, wherein the extrapolator performs extrapolation processing in which an analysis order of the narrowband line spectrum pair parameter is made ½ of an analysis order of the wideband line spectrum pair parameter.

13. The scalable encoding method according to claim 9, further comprising:

applying, with a window applier, to the series of autocorrelation coefficients, a window which has an inverse characteristic of a lag window that is applied to the narrowband line spectrum pair parameter.

14. The scalable encoding method according to claim 9, wherein the first convertor converts the narrowband line spectrum pair parameter into the series of autocorrelation coefficients by converting the narrowband line spectrum pair parameter into a series of linear prediction coefficients and converting the series of linear prediction coefficients into the series of autocorrelation coefficients.

* * * * *